US007661207B2

(12) United States Patent
Monsees et al.

(10) Patent No.: US 7,661,207 B2
(45) Date of Patent: Feb. 16, 2010

(54) SNOWSHOE BINDING WITHOUT HEEL STRAP

(75) Inventors: James Monsees, Menlo Park, CA (US); Daniel T. Emerson, Berkeley, CA (US); Peter W. Chapman, Oakland, CA (US)

(73) Assignee: K-2 Corporation, Seattle, WA (US)

( * ) Notice: Subject to any disclaimer, the term of this patent is extended or adjusted under 35 U.S.C. 154(b) by 609 days.

(21) Appl. No.: 11/334,056

(22) Filed: Jan. 17, 2006

(65) Prior Publication Data

US 2007/0163151 A1 Jul. 19, 2007

(51) Int. Cl.
*A43B 5/04* (2006.01)

(52) U.S. Cl. ..... 36/122

(58) Field of Classification Search ..... 36/122–125
See application file for complete search history.

(56) References Cited

U.S. PATENT DOCUMENTS

| | | | | |
|---|---|---|---|---|
| 1,570,791 | A | 1/1926 | Solarz | |
| 2,317,647 | A | 4/1943 | Simunds | |
| 2,738,596 | A * | 3/1956 | Walsh | 36/124 |
| 4,720,927 | A | 1/1988 | Abegg | |
| 5,440,827 | A | 8/1995 | Klebahn et al. | |
| 5,918,387 | A | 7/1999 | Emerson | |
| 6,052,922 | A | 4/2000 | Bleck | |
| 6,374,518 | B2 | 4/2002 | Warner | |
| 6,401,310 | B1 | 6/2002 | Warner et al. | |
| 6,526,629 | B1 | 3/2003 | Warner et al. | |
| 6,694,645 | B2 | 2/2004 | Messmer et al. | |
| 6,694,646 | B2 | 2/2004 | Messmer et al. | |
| 7,497,034 | B2 * | 3/2009 | Emerson et al. | 36/124 |
| 7,509,757 | B2 * | 3/2009 | Monsees et al. | 36/122 |
| 2007/0163154 | A1 * | 7/2007 | Emerson et al. | 36/122 |

* cited by examiner

*Primary Examiner*—Marie Patterson
(74) *Attorney, Agent, or Firm*—Thomas M. Freiburger

(57) ABSTRACT

A snowshoe binding engages the sole of the user's boot in a region between the arch and the widest part of the sole, gripping the sole laterally and sufficiently firmly that the boot will not pull out of the binding during use of the snowshoe, even in the absence of a heel strap. The arch area of the boot typically is narrower in width than the ball of the foot, providing a rearwardly tapering region for positive engagement against pulling back of the boot in the binding. By engaging the boot at the sole, the binding can put pressure on the boot not felt by the user. In one form the sole engaging binding device has a width adjustment with a sliding element, and the firmly clamping sole engagement preferably is accomplished with a cam that engages when a strap is tightened. An efficient buckle and strap are also disclosed.

26 Claims, 12 Drawing Sheets

SNOWSHOE BINDING WITHOUT HEEL STRAP

BACKGROUND OF THE INVENTION

This invention concerns snowshoes, particularly a snowshoe binding for retaining a user's shoe or boot (referred to as boot herein). Importantly, the invention provides an improved binding that avoids the need for a strap extending around the back of the user's boot, still providing for secure retention of the boot in the binding.

Snowshoe bindings, and bindings for cleats or other terrain-engaging footgear, are shown in Atlas Snowshoe Co. U.S. Pat. Nos. 5,440,827, 5,918,387, 6,374,518, 6,401,310, 6,526,629, 6,694,645 and 6,694,646. U.S. Pat. No. 6,694,646 disclosed a snowshoe harness with buckles and straps configured such that a single pull can tighten the harness down to the boot, and including toe area and arch area straps whose tails were connected together as a loop, such that the user need only pull on the loop. As shown in nearly all the above listed patents, a heel strap is provided to secure the user's boot in the binding, to prevent against pulling back of the boot from the tightened toe and arch areas on the binding during use of the snowshoe or cleat device.

It would be convenient and efficient if such a heel strap could be eliminated from a boot binding for snowshoes, cleats or other footgear, but no previous snowshoe binding has been suggested that would securely grip and hold the boot (which can be in many different sizes, shapes and sole configurations) without a heel strap.

SUMMARY OF THE INVENTION

According to the invention, a snowshoe binding engages the sole of the user's boot in the arch area or farther forward, in a region behind the widest part of the sole, gripping the sole laterally and sufficiently firmly that the boot will not pull out of the binding during use of the snowshoe, even in the absence of a heel strap. The boot typically narrows from a widest point near the ball of the foot back to the arch area, so that any part of this narrowing region can provide for a positive engagement against pulling back of the boot in the binding. The boot is firmly engaged between the toe strap and the sole grip, against fore/aft movement. By engaging the boot at the sole, the binding can put pressure on the boot not felt by the user. The sole engaging binding device preferably has some form of width adjustment, such as a sliding element, a swingable, pivoting element, or a screw adjustment, and the locking of the sole engagement preferably is accomplished with a cam that engages when a strap is tightened, but other clamping or gripping structures could be used.

In one preferred embodiment the snowshoe binding of the invention, which eliminates the need for a heel strap, includes a binding footbed with a toe bearing area for receiving the toe or ball of the foot area of a user's boot, a strap passing over the boot in the toe or the ball of the foot area, and a footbed portion with an arch bearing area for receiving the arch region of the user's boot. A strap is secured to the footbed at or near the arch area and passes over the boot generally at the arch area for connection back to the footbed at or near the arch area. A blocking means is connected to the footbed for laterally engaging the boot at the sides of the sole where the sole is narrower than in the ball of the foot area, and for tightening the engagement to the extent that the binding firmly engages the user's boot, so that the boot will not pull back out of the binding in the absence of a heel strap.

The blocking means in one specific embodiment comprises a fixed sole-engaging lip or edge connected to the footbed at one side, and an adjustable sole gripper with a release position and an engage position at the other side of the footbed, behind the ball of the foot area where the boot sole is widest. The adjustable sole gripper can be moved by the user from the disengaged to the engaged position to firmly grip the sole of the boot. A specific implementation includes a cam pivotally connected to one side of the footbed in the gripping area, opposite the position of the sole-engaging lip, the cam having the two positions described, the release position wherein the cam is swung out and away from the boot sole and the engage position wherein the cam is swung inwardly on the pivot connection, engaging the cam firmly against the boot sole to retain it in place in the binding.

In a preferred and specific embodiment of the binding the cam forms a part of or is connected to a strap buckle, with the cam pivotally connected to an extension on the footbed. The buckle can pivot relative to the cam if desired, on a transverse axis. The strap at the arch area of the binding is connected to and adjustable via the strap buckle, such that when the arch area strap is pulled to tighten the strap through the buckle, pulling force on the strap lifts an upper end of the cam to pivot the cam relative to the footbed thereby causing the cam to engage against the boot sole. Thus, the user effects tightening of the arch area strap and firm engagement of the sole by the sole gripper with a single manipulation.

Other means that can be used for engaging or clamping the boot sole include a slider with a set screw or with an adjustable screw, a spring lock disengageable by a lever, or various forms of over-center engagement devices.

Another aspect of the invention is a buckle and strap combination preferably used on the binding.

It is therefore among the objects of the invention to eliminate the need for a rear strap in a snowshoe binding or similar binding, via a binding that engages a rearwardly narrowing region of the user's boot sole in such a way that the boot is firmly retained in the binding, against pulling back away from the binding, even under stressful use of the snowshoe or other implement. These and other objects, advantages and features of the invention will be apparent from the following description of a preferred embodiments, considered along with the accompanying drawings.

DESCRIPTION OF PREFERRED EMBODIMENTS

Figure 1:
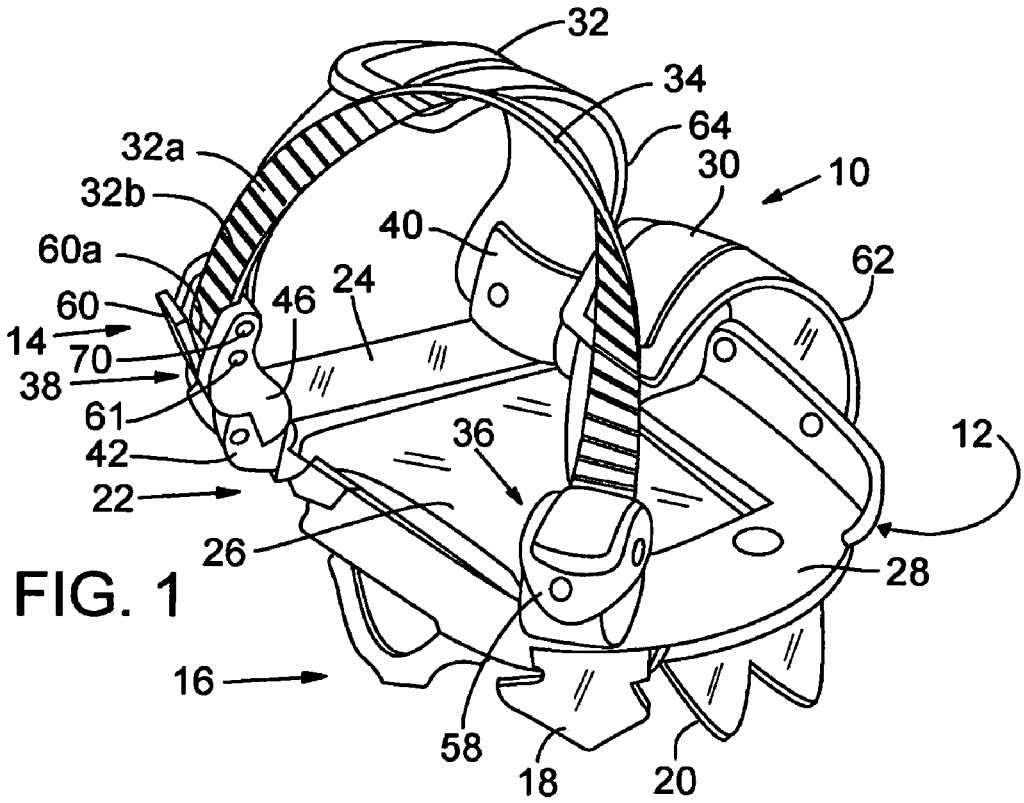
FIG. 1 is a perspective view showing a binding for a snowshoe or other sport footwear, incorporating the principles of the invention.

FIG. 1 shows a boot binding for a snowshoe, a cleat or other sporting footwear, generally identified by the reference number 10, in one specific embodiment. The toe end of the binding is at 12, and the arch region is approximately at 14.

The drawings show a form of binding 10 that can be engaged with a snowshoe. At the bottom of the binding is a cleat 16, which includes a series of terrain-engaging portions or teeth 18, 20, etc., not forming specific subject matter of this invention. The binding 10 is designed to be used in conjunction with a carrier plate that may be permanently affixed to a snowshoe, such that the binding and snowshoe are modular items, which is the subject matter of a copending application owned by the assignee of this invention. However, the binding construction 10 can apply to bindings that are fixed to snowshoes or to cleats not a part of snowshoes, or other applicable footwear, the modular concept not being a part of this invention.

The binding 10 has a footbed generally identified as 22. This footbed, unlike those shown in several of the above Atlas Snowshoe patents, includes a relatively rigid bearing area 24, which can be called a rear bearing area, extending across the width of the sole in that region so that a portion of the user's boot, behind the ball of the foot, engages this area. The engagement point on the boot can be anywhere from just behind the widest part of the sole back to the arch, where many soles reach a minimum width. The strip defining the bearing area 24 can be entirely rigid, but should be at least relatively rigid, sufficient to substantially resist twisting of the boot on the yaw axis (in the ground or horizontal plane). The footbed 22 continues forward via a middle section 26, which may be flexible so as to conform to and allow bending movement of the user's boot as steps are taken (bending in the pitch direction). Again, this forms subject matter of a copending patent application, and for purposes of the current invention, this section 26 (and the entire footbed) can be rigid if desired. At the toe or ball of the foot area 12 at the front of the binding 10, a toe bearing area or front bearing area 28 is secured to the mid-section 26 of the footbed and provides a surface for receiving the toe or ball of the foot area of the user's boot. This is the forward end of the footbed 22.

This binding differs from that shown in the above referenced U.S. Pat. No. 6,694,646. Again, there are two straps passing over the user's boot, a first strap or front strap 30 over the toe area (usually forward of the ball of the foot), and a second strap or rear strap 32 over the arch area. Also, as in the '646 patent, the two straps are connected together (preferably as a single strap, but they could be attached at ends) forming a single gripping loop 34 by which both straps may be tightened via respective tightening buckles 36 and 38. This binding differs in one respect in that the bearing area 24 is essentially rigid and spans across the footbed, rather than the rear extension, single point strap connection shown in the '646 patent. This feature of the invention provides better stability for the user against twisting in the horizontal plane. Further, if the footbed is flexible so as to allow bending of the mid-section 26 with the user's boot sole as steps are taken, it is important that the straps 30 and 32 be independent from each other at both left and right sides, not bound together by a heavy webbing or pad, so that the footbed can flex. Also, the wearer's left side of the binding 10 as shown in FIG. 1 (the inner side when worn) is secured to a strap that is fixed to the footbed, rather than being adjustably slidable and floating on a loop element as in the '646 patent.

The most important distinctions of the current design include those features which allow elimination of a heel strap that passing around the back of the user's boot. The rigidity of the bearing area or strip 24 is important in this respect, because it provides a platform for laterally pinching or clamping the sole of the user's boot, in a region narrower than the widest part of the sole, to firmly retain the boot in the binding against the tendency to pull backward out of the binding. The loop pull 34 on the strap cooperates well with this feature, but the heel-strap-free construction is a very important feature and stands alone and independent of other features such as the loop pull 34; individual toe and arch straps could be provided if desired.

The bearing area 24 of the binding has a sole-engaging lip or bracket 40 that engages the boot sole at one side, in the area between the arch and just behind the ball of the foot. At the opposite side is an engagement, preferably adjustable as to width, that forms the other side of a blocking device that blocks rear pullout movement of the boot by clamping the sole. In one preferred embodiment, adjustment is provided via a slider 42 that extends into the body of the bearing platform 24. This is understood with respect to the exploded view of FIG. 2 and the schematic cross sections of FIGS. 3 and 4. The slider 42 slides in/out of a slider body 44, the top surface of which comprises the boot bearing area 24. The slider and the slider body are provided with some form of locking device whereby the slider is locked against pulling outwardly once set. This could be a set screw with manual knob (not shown), or something similar. It could also be a ratcheting arrangement by which the slider 42 can always be pushed inwardly (until it reaches its inner limit), but cannot be pulled outwardly without the user's engaging a release button or lever. By that engagement, the user releases the slider using the button or lever (not shown), and pulls the slider out sufficiently for the boot, and puts the boot in the binding with the boot arch (or a nearby sole portion) against the bearing area 24. Then the slider is pushed in to the correct width for the user.

Figure 2:
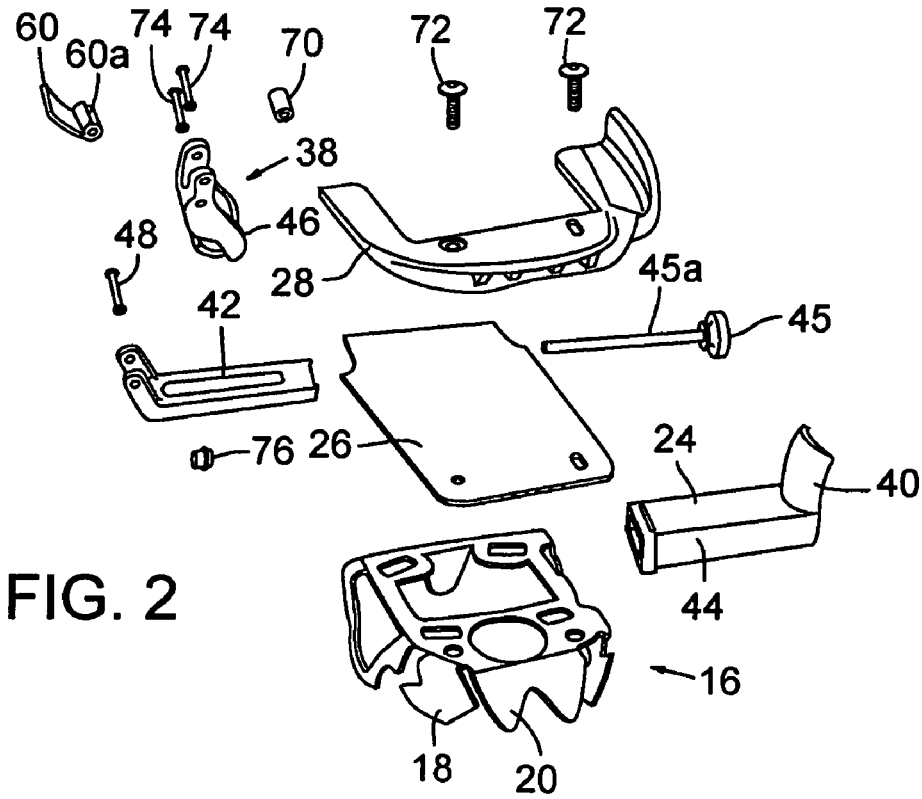
FIG. 2 is an exploded view in perspective showing some of the components of the binding of the invention, in one embodiment.

An alternative arrangement is shown in the exploded view of FIG. 2. An adjustment knob 45 and attached threaded shaft 45*a* engage through the slider body 44 with a threaded hole (not seen) in the slider 42. In this form, the slider 42 is permitted outward movement as the adjustment knob is rotated in a backing-off direction, for expanding the boot opening; and is drawn closer toward a boot or shoe when rotated in the tightening direction.

If desired both sides of the rear bearing area 24 could have slidable or otherwise movable components for adjustably engaging with the sides of a boot sole. Pivoting arrangements or longitudinal sliders (with increasing thickness along the slider length) could be employed. Devices generally as used on water skis or snow skis could be used, so long as different widths can be accommodated.

FIG. 2 also shows mounting bolts 72 for retaining the toe bearing area, i.e. the front end of the footbed 28, through the flexible mid-section or plate 26 and down to securement with the cleat 16. Connecting rivets are shown at 74 in the buckle 38, and at 48, serving as the pin for the slider 42, to be engaged with the buckle 38. A nut is shown in FIG. 2 at 76, fitting into the slider 42 to provide the thread for engagement with the threaded rod 45*a*. This can be, for example, a 10-32 Nyloc PEM style nut.

Tight gripping engagement of the user's boot, to clamp the boot firmly in place, may be made with a cam device 46. The cam device is pivotally attached to the outer side of the slider 42, which acts as a lateral extension of the footbed in the arch area. The pivot point is shown at 48, a pin in a preferred embodiment, engaged through the cam device. If desired the cam device could be removably attached to the footbed or slider, as by a hook on the cam to be engaged over the pin, allowing release of the strap.

Figure 3:
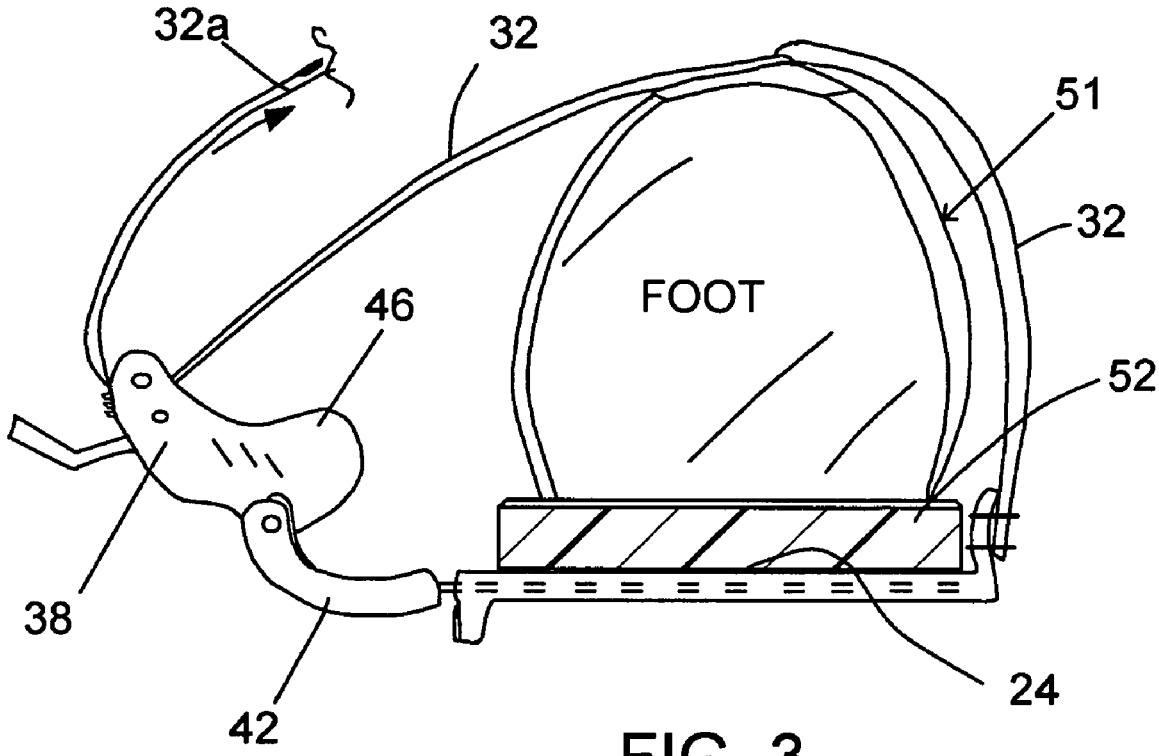
FIG. 3 is a transverse cross sectional view schematically showing a binding of the invention on a user's shoe, at the arch area, prior to engagement of the binding, for the form shown in FIGS. 1 and 2.
Figure 4:
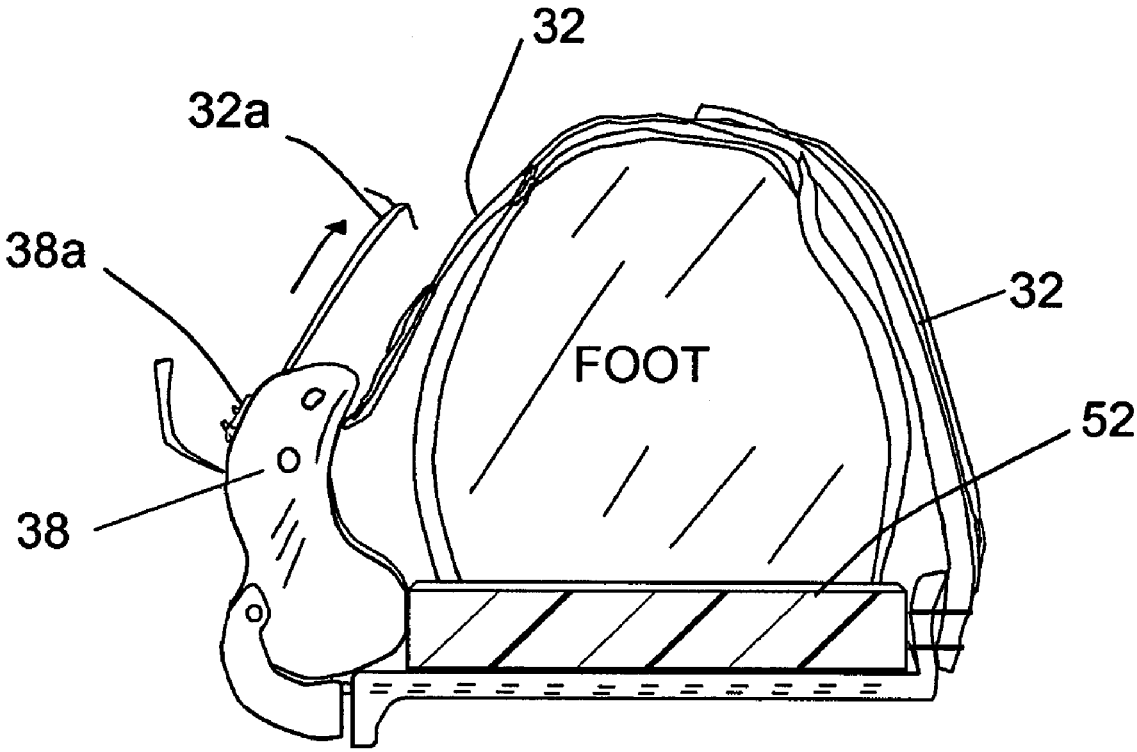
FIG. 4 is a transverse cross sectional view similar to FIG. 3, but showing the binding engaged against the user's boot in the arch area.

FIGS. 3 and 4 show engagement of the adjustable sole gripper that comprises the slider 42 and the sole-gripping cam device 46. With the sole 52 of the user's boot 51 placed in the binding, with the sole against the bearing area 24, the slider 42 is outward. With the boot thus positioned, the slider 42 is moved inwardly until the cam 46, rotated outwardly as shown, bumps against the boot sole 52. Then, the cam device 46 is pivoted upwardly (clockwise in FIGS. 3 and 4) to tightly engage against the side of the sole 52, via the increasing radius of the cam as it pivots clockwise, as can be seen in FIG. 4, gripping and clamping the sole between the sole gripping elements at both sides. This provides enough force to retain the boot in place during use of the snowshoe or other implement.

In a preferred embodiment, as shown in the drawings, the strap 32 is connected to the cam device 46, so that the cam is engaged by pulling on the strap. Further, the cam device 46 may be integral with or attached to a buckle 38 that tightens against the strap 32 as the strap is pulled through via a tensioning or pulling portion of the strap 32*a*. The buckle 38 preferably is a cam lock buckle with teeth 38*a* that engage against the strap, preventing back-slippage of the strap through the cam lock buckle (examples of such buckles are shown in Atlas Snowshoe U.S. Pat. Nos. 6,401,310 and 6,526,629, although the buckles 36 and 38 are somewhat modified—the buckle can be a nipple-and-hole type buckle as in U.S. Pat. No. 6,401,310 if desired).

Thus, in a most preferred form of the invention, pulling of the strap in the area 32*a* will pull up and rotate the buckle 38 and cam device 46 (which may be separate but attached) in the clockwise direction (as viewed in FIGS. 3-4), clamping the user's boot sole from the two sides of the binding and blocking the boot from pulling back, and at the same time the strap 32 over the arch area is tightened as desired. In a specific and preferred form of the invention, the strap single-pull loop 34 is included, so that both front and rear straps 30 and 32 are tightened to the needed extent simultaneously, and the sole gripper device is also engaged simultaneously. The front buckle 36 may also be a ratcheting type, one-way buckle that allows tightening but not back-slippage, until released. Release levers for the two buckles are shown at 58 and 60.

The straps 30 and 32, which, as noted above, can be one single strap in a preferred embodiment, are to be understood as including the illustrated front strap pad 62 and arch strap pad 64. Whether or not these pads are included, the strap as described herein and in the claims is intended broadly, to include either a simple strap or a strap in combination with a strap pad, or a web-type strap portion at 62 and 64, to which the ends of the actual straps may be connected. The web-type portion 62 and 64 would then be part of the strap. "Strap" is to be understood broadly unless indicated otherwise.

FIG. 1 also indicates that the straps 30 and 32 (looped together at 34), i.e. the straps themselves and excluding the pads 62 and 64, preferably are formed in a textured configuration. The straps can be constructed of a corrugated webbing, with a waterproof covering over the strap, which typically gives the strap a rubber-like, high-friction surface. The straps are high-strength and are positively gripped by the buckles 36 and 38. Because of the high friction, the buckles preferably include a roller at 70, also shown in the exploded view of FIG. 2, for low-friction passage of the strap through the buckle during tightening and also release of the straps.

In the drawings the buckles are shown attached to the footbed of the snowshoe binding. Although this is the preferred position for the buckles, so that the strap loop extends upwardly from these buckles and requires an upward pull by the user, it should be understood that the buckles could be arranged generally in the positions shown in U.S. Pat. No. 6,694,646. In other words, the straps could be located at upper regions, at the ends of straps or harness portions that connect to the side of the footbed opposite that where the buckles are shown in the drawings. In that case, at the locations where buckles are shown in FIG. 1, the straps would simply be connected to the footbed or to the cam device 46. Rollers are preferably included in the buckles for direction reversal of the strap, to pull through a high-friction strap. Pulling of the straps would still preferably rotate the blocking means, i.e. the boot sole engaging cam device in the direction to engage the boot sole. The strap loop for tightening the straps (or individual strap tails, if the loop is not included) would be pulled in a different direction from that of the embodiment illustrated. If desired, the buckles could even be located on the footbed at the opposite side from that shown in the drawings.

Figure 5:
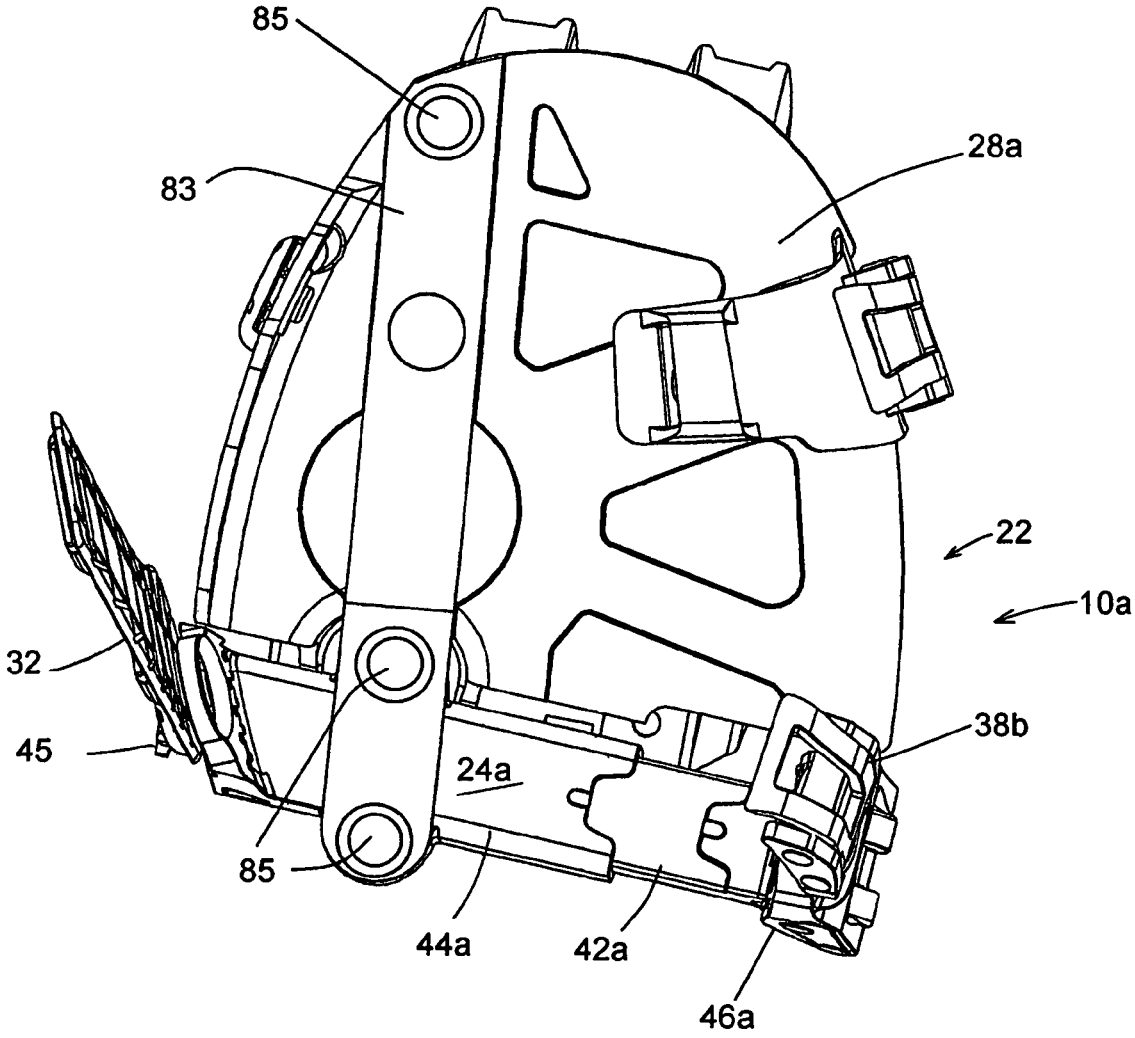
FIG. 5 is a perspective plan view showing another form of the sole gripper device with width adjustment.
Figure 6:
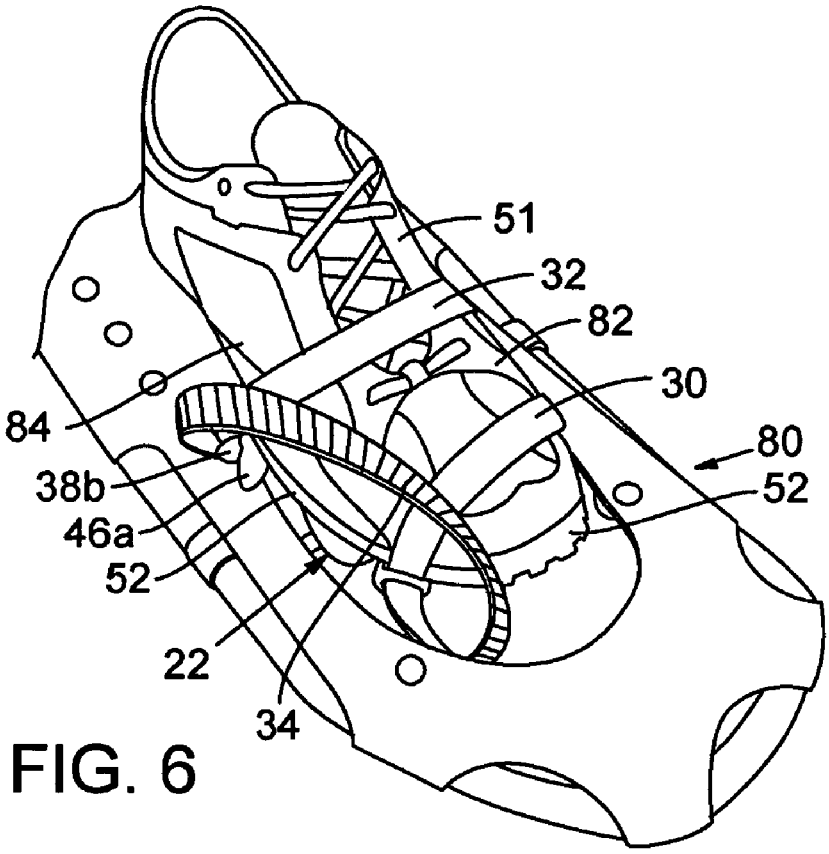
FIG. 6 is a perspective view showing a user's boot secured in a snowshoe with a binding according to the invention.

FIGS. 5-15 show another form of the invention, with FIG. 6 illustrating the user's boot in the binding of the invention. In FIGS. 5-15 the cam device is shown in a somewhat modified form from that described above.

In FIG. 6 the user's boot 51 is shown retained in a snowshoe 80 using a binding of the invention, which may be a part of the snowshoe, secured permanently thereto, or which may be a removable, modular binding such as shown at 10 in the first embodiment, securable to a carrier plate of a snowshoe. FIG. 6 shows that the front binding strap 30 engages over the boot in the toe area, preferably forward of the ball of the boot, where the boot is sharply tapering toward its front end. The rear strap 32, extending generally over the arch area of the boot 51, connects to the footbed 22 in a region which is behind the widest point 82 of the boot sole 52, but which is forward of the arch 84 of the boot. This allows for the absence in some boots (shoes) of an engagable sole in the arch area, and also places the gripping or clamping force on the sole in a region of rearwardly narrowing taper, such that the ball of the foot area of the shoe is actually pinched or clamped between the front strap 30 and the sole gripper, a cam device 46*a* of which is seen in FIG. 6. The front strap 30, being in a region of strong taper of the boot, prevents the boot from pushing forward against the tightened strap, while the sole gripper prevents the boot from pulling backward. Note that the rear strap 32 does little to prevent pulling back the boot, although it holds the boot down against the footbed and, along with the front strap 30, prevents the boot from pushing further forward. Note also that in this form of the invention the rear buckle 38*b* is non-integral with, but connected to, the cam device 46*a*.

FIG. 5 shows this binding, identified as 10*a*, in plan view and without all of the straps. The buckle 38*b* is shown above and connected to the cam device 46*a*, which in turn is connected to a slider 42*a*, which slides in the rear sole bearing strip or slider body 44*a*, providing the rear bearing surface 24*a*. An adjustment knob 45 (barely visible in FIG. 5) controls the position of the slider 42*a*, with a threaded rod as discussed above, for this particular embodiment. Here, the rear sole strip/slider body 44*a* is connected to a front part or toe bearing area 28*a* of the footbed by a spring flex bar 83, which may be of stainless steel (304 full hardness, for example, about 0.6 mm thick), or other appropriate leaf spring material. Fasteners are shown at 85. The rear bearing device and area 44*a*, 24*a* is separate from the front bearing area 28*a* (which may be of carbon fiber-reinforced plastic) of the footbed, allowing the foot to bend in an essentially natural way as the wearer of the snowshoe moves his opposite foot forward with the subject foot remaining in place.

Figure 7:
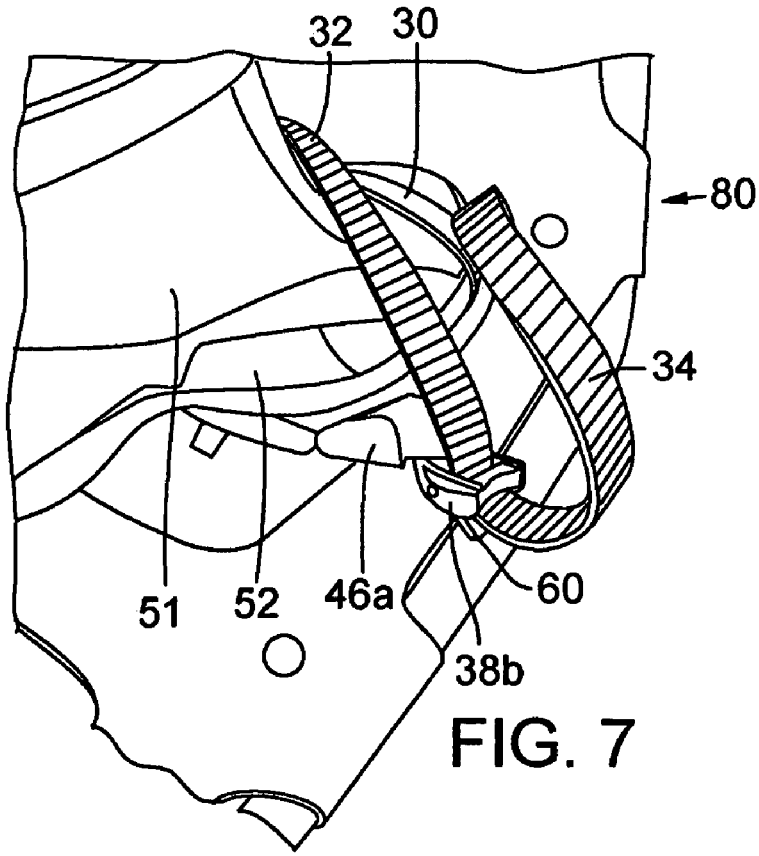
FIG. 7 is a perspective view showing the sole gripper device of FIGS. 5 and 6, in a position disengaged from the user's shoe.
Figure 8:
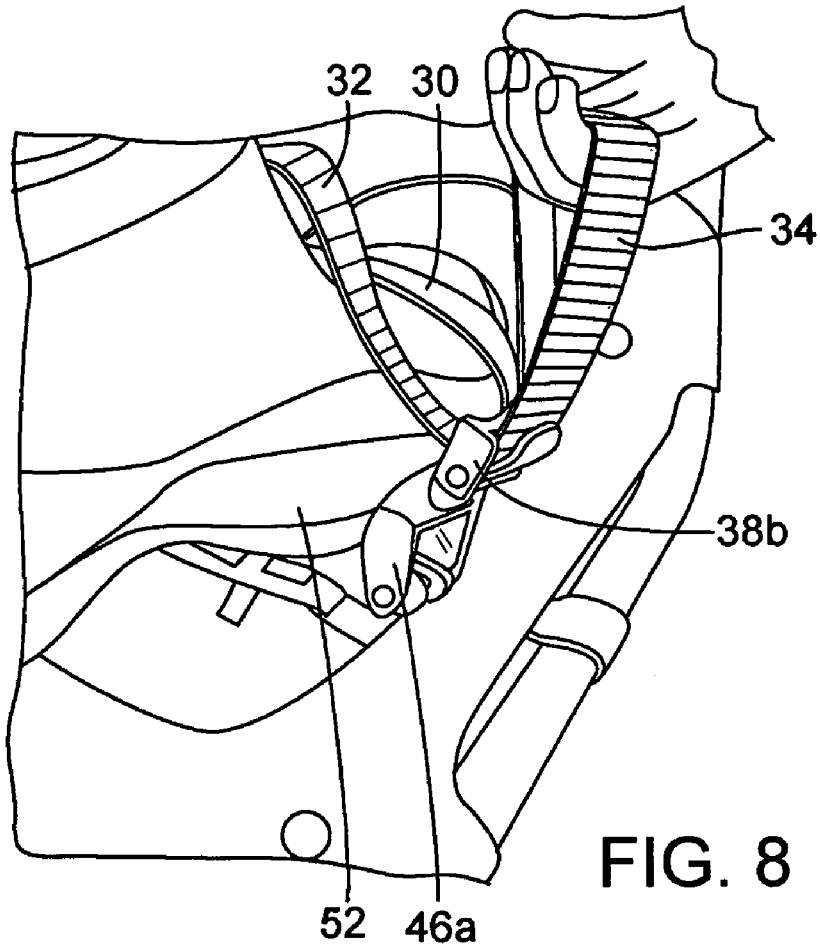
FIG. 8 is a perspective view similar to FIG. 7, showing the sole gripping device being pulled into the engaged position.
Figure 9:
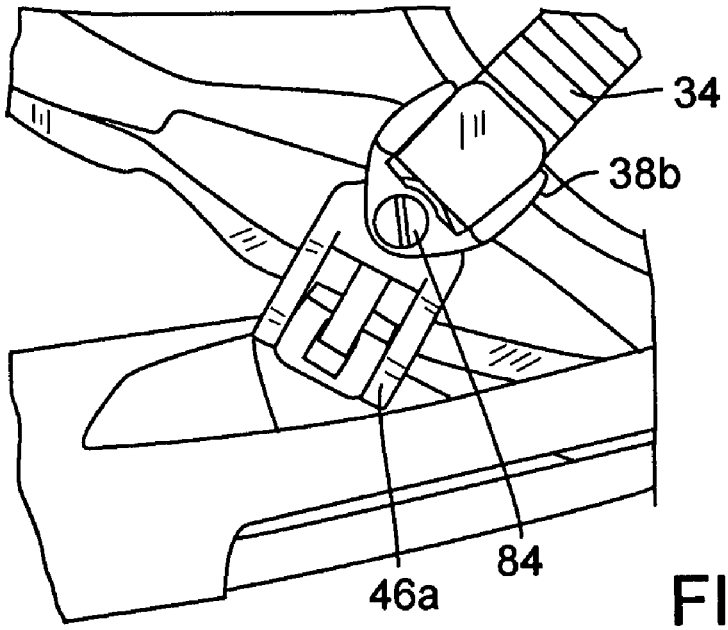
FIG. 9 is a side view of the embodiment shown in FIGS. 7 and 8.
Figure 10:
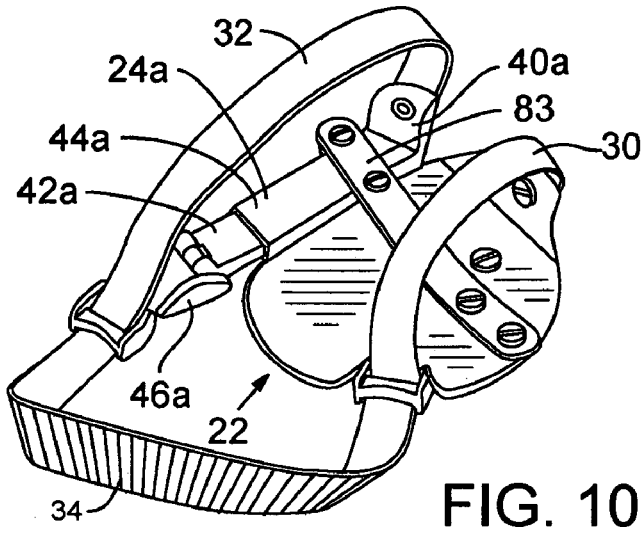
FIG. 10 is a perspective view showing a portion of the binding of the embodiment of FIGS. 5 through 9, as removed from the snowshoe.

The same binding is also seen in FIGS. 7-10, as well as in FIGS. 11-15. In FIGS. 7 and 10 the cam device 46*a* is pivoted downwardly/outwardly, so that the boot 51 can be slid forward into the binding without obstruction from the cam device. Preferably the cam device pivots down to at least about flush with the top surface 24*a* of the rear sole bearing strip/slider body 44*a* of the footbed. A slider 42*a* is slidable into and outwardly from the slider body 44*a*, at the rear of the footbed 22. The wearer slips the boot 51 forwardly, inserting the toe of the boot into the front strap 30, then, with the inner side of the boot against a lip or bracket or wall 40*a* at the inner side of the binding (the wall 40*a* may be angled to generally match the boot taper and assist in resisting pullback, as shown in FIGS. 5 and 10), the wearer pushes in the slider 42*a*, if such slider is provided, until the cam device 46*a* is adjacent to the boot sole. Then the wearer pulls upwardly on the strap loop 34 (or on the tail end of the individual strap 32, if the loop is not provided), and this raises the cam device 46*a* upwardly as shown at FIG. 8. With further tightening of the strap the tension in the strap will pull the cam device 46*a* firmly against the boot sole 52, firmly clamping the sole in this region of rearward taper. The cam device is configured such that shoe sole force exerted below a certain level on the cam will lock the cam device more firmly in place. The cam device can include an angle that generally matches the tapering angle of the sole in this region. Note that the slider can be provided with locking means in any of the forms discussed above, or in another form. Also, the lip or wall 40*a* can have bumps or other texture to engage the sole, and the cam can have generally vertical ridge lines to engage the sole.

With the straps tightened, the boot is firmly held by the two straps and the sole gripper, not only preventing pullback of the boot in the binding but also providing a relatively firm connection with the binding so that twisting in the horizontal plane relative to the snowshoe is virtually eliminated. The result is a much more secure attachment to the snowshoe and feeling to the user.

FIG. 9 shows the boot or shoe firmly retained in the binding and illustrates that the rear buckle 38*b* can be secured to the cam device 46*a* with a fastener 84, e.g. a rivet or machine bolt. This can allow pivoting about the fastener on a generally traverse axis, as illustrated, helping to accommodate different boot sizes and configurations. As in the earlier embodiment, the straps 32 and 30 in a preferred embodiment are textured, and may have a high friction waterproof coating, so that the buckle 38*b* advantageously includes a roller as described above, for allowing efficient slipthrough of the strap in this preferably cam lock type buckle.

Figure 16:
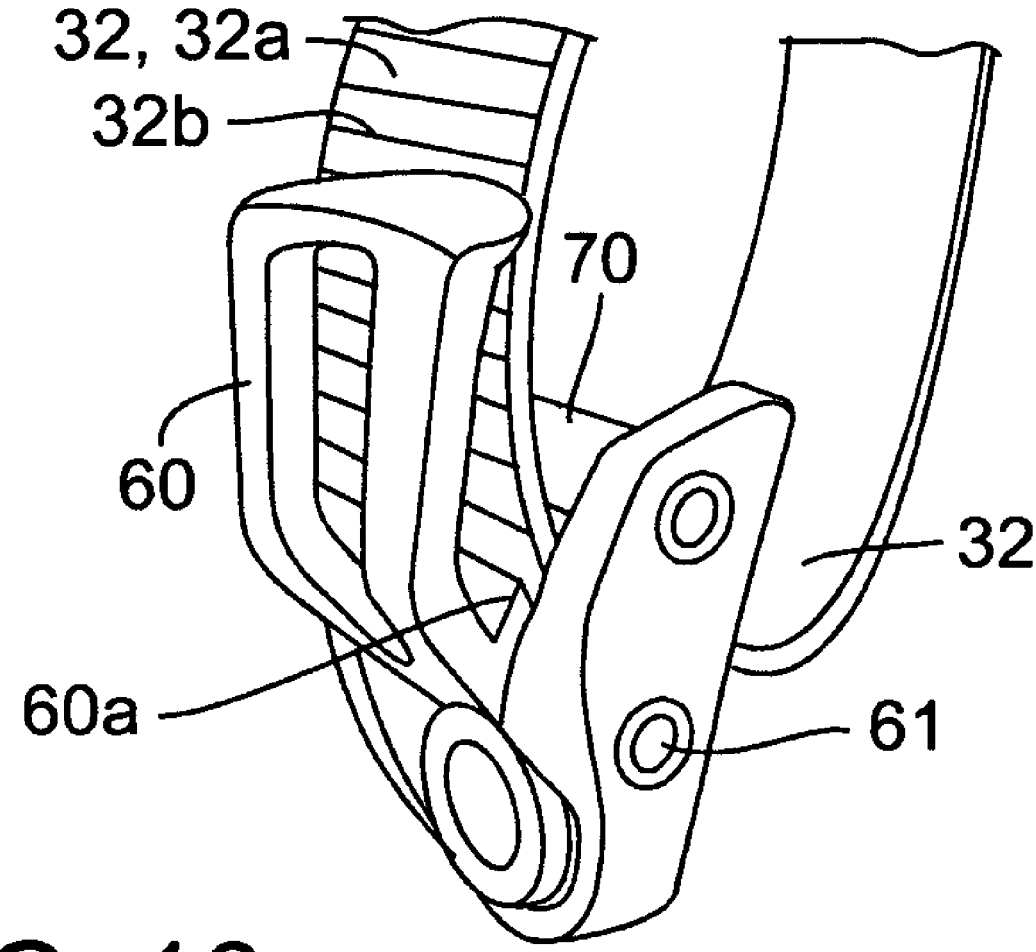
FIG. 16 is a detail-view of a buckle and strap of the invention.

The preferred buckle and strap arrangement for the binding is shown in FIG. 1 and discussed above, and also shown in FIG. 16. A lever 60, although it could be of plastic, preferably as of metal such as aluminum, and has a series of teeth 60*a*, visible in FIGS. 1 and 16, at increased distances from the buckle pivot axis 61 in the direction of the lever, to produce the cam action of the buckle. The teeth 60*a*, extending as lateral ridges, preferably are spaced similarly to corrugations or ridges 32*b* on the strap 32 that passes through the buckle. A spring, preferably a torsion spring (not shown), biases the lever and teeth toward the strap 32, as the strap passes over the roller 70, with moderately strong biasing force. Thus, the cam lever firmly and positively engages with the corrugations of the strap 32 to prevent pullback in the loosening direction of the strap, while allowing the user readily to pull the tail end 32*a* of the strap through the buckle in the tightening direction. The roller 70 greatly reduces friction. The buckle and strap act in a ratcheting function due to the similar spacing of the lever teeth and the strap ridges, the spring biasing of the lever and the low-friction roller 70.

Figure 11:
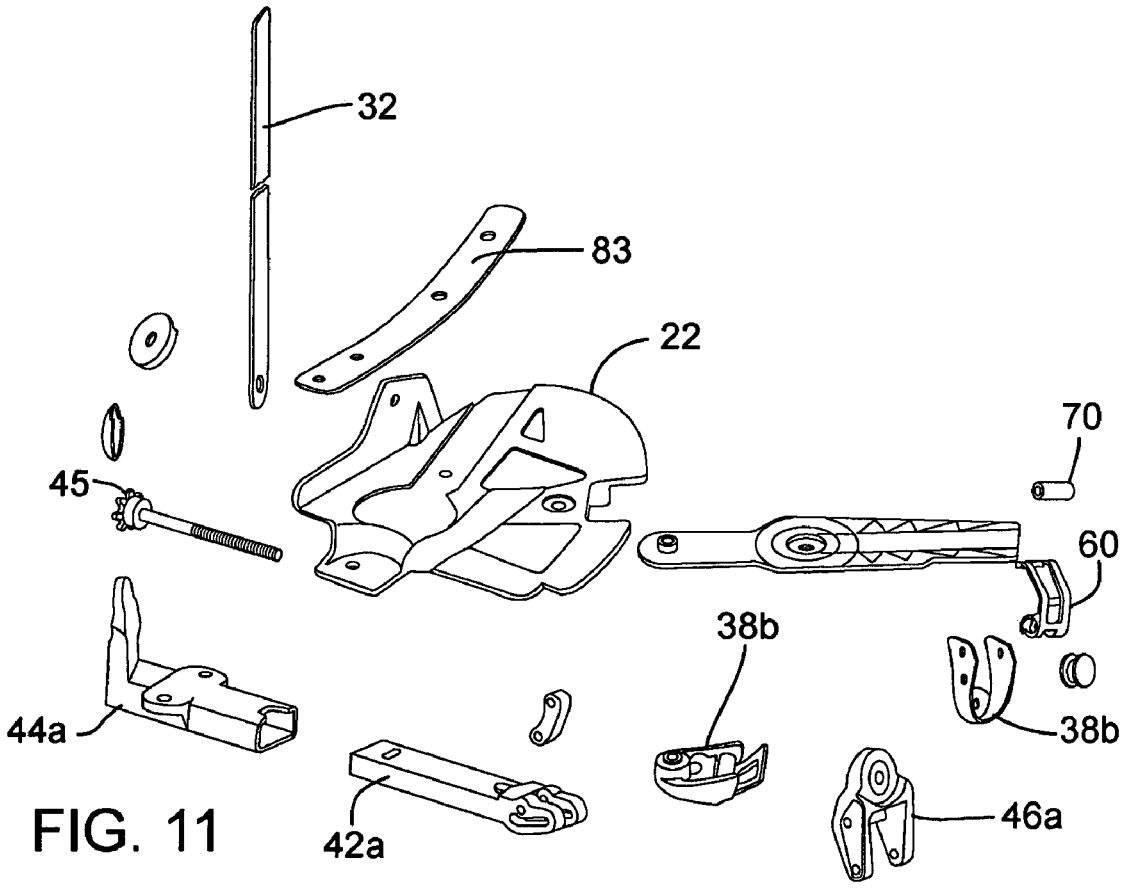
FIG. 11 is an exploded perspective view showing components of the form of binding shown in FIGS. 5 through 10.

FIG. 11 is somewhat similar to FIG. 2, showing in exploded perspective view the principal parts of the binding of FIGS. 5-10. FIGS. 12-15 illustrate the slider and cam, as well as the buckle, and the manner of operation.

Figure 12:
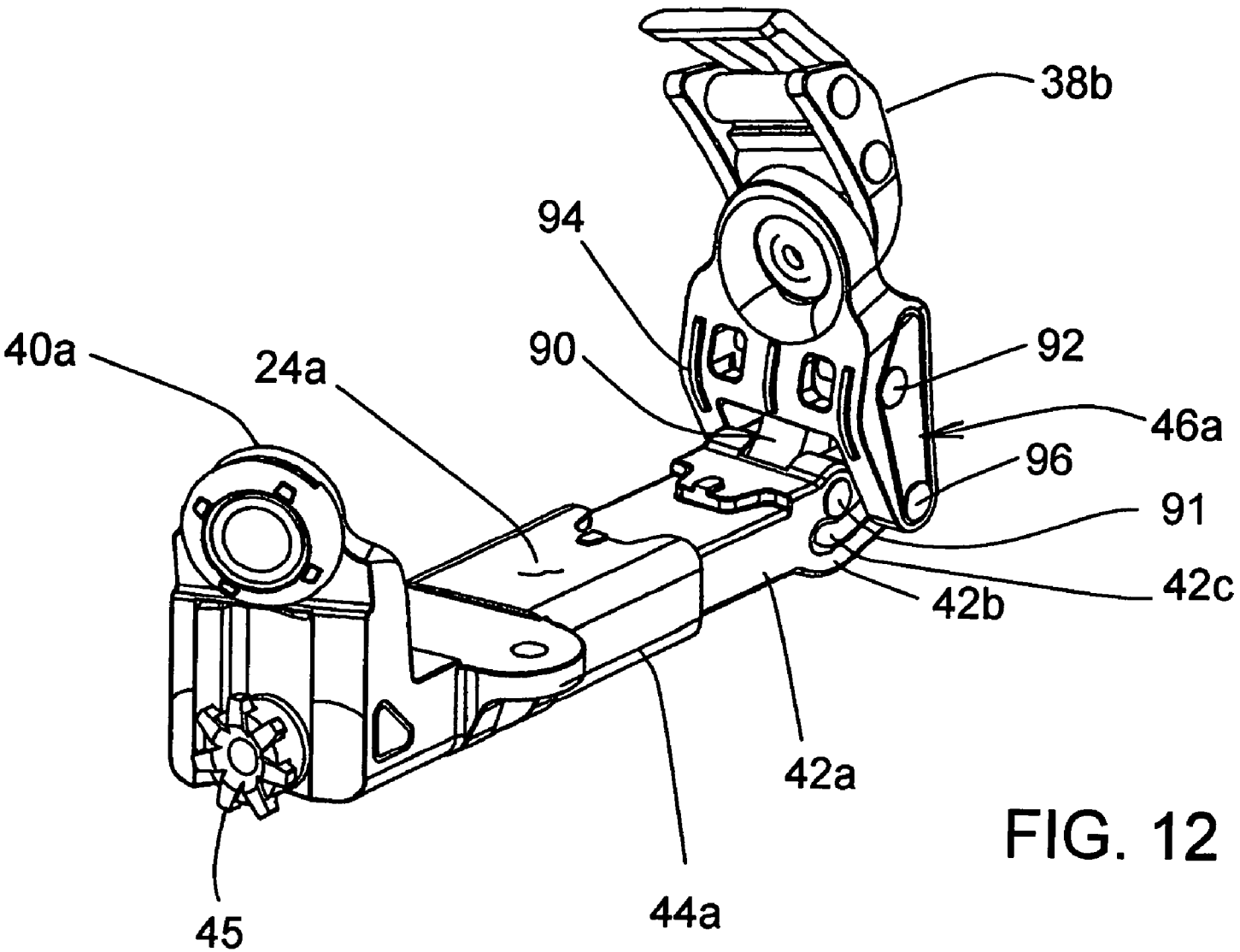
FIGS. 12 through 15 are perspective and side views of the width adjustment and cam binding elements of the embodiment of FIGS. 5-10, shown in different positions.
Figure 13:
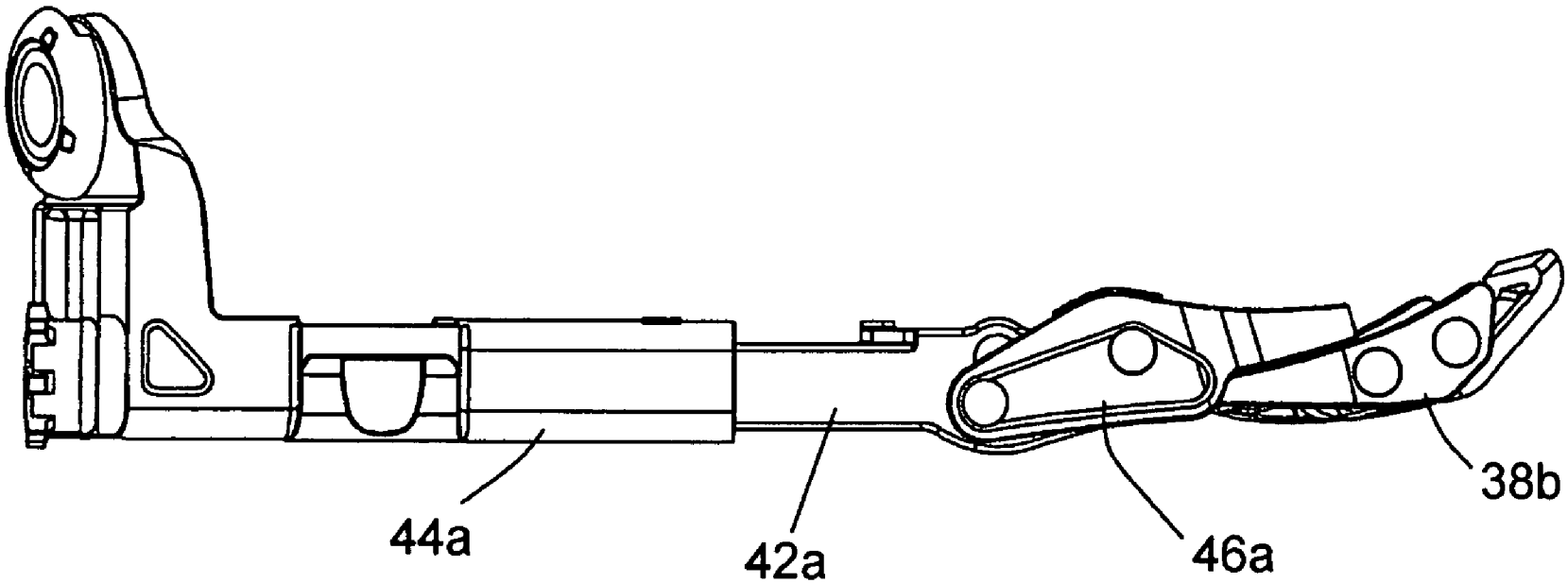
Figure 14:
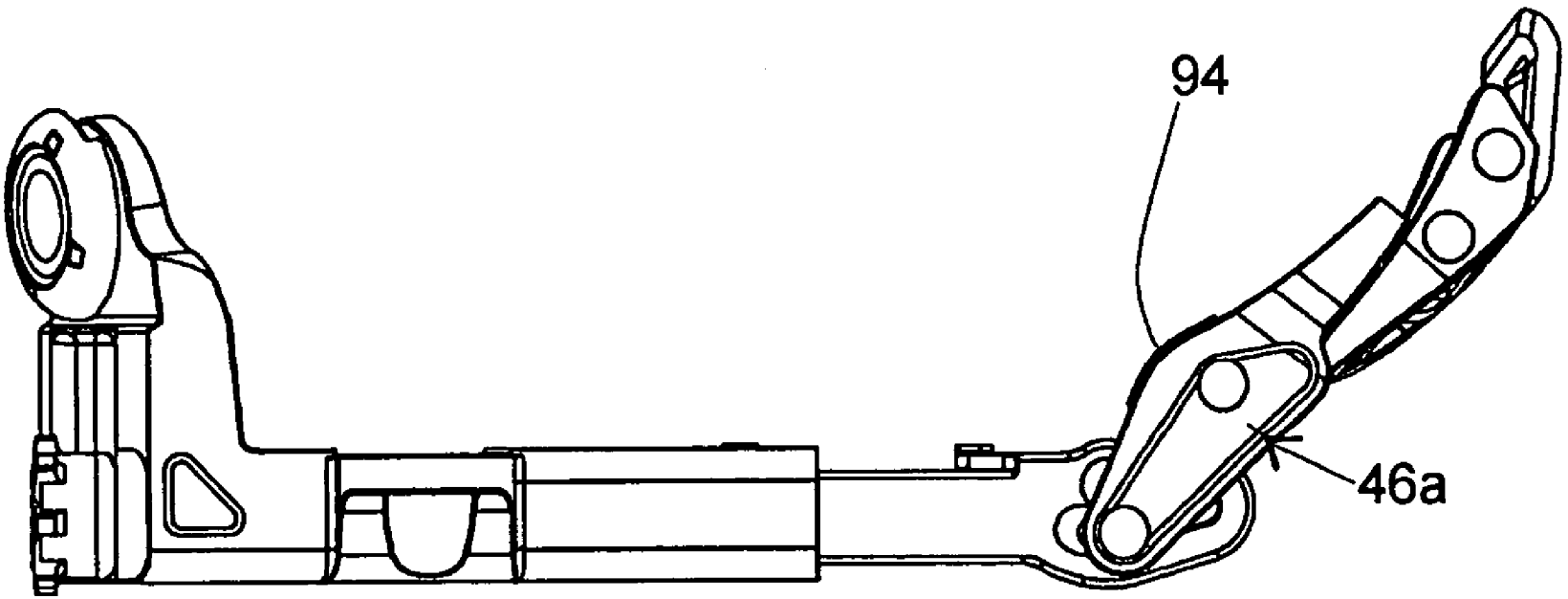
Figure 15:
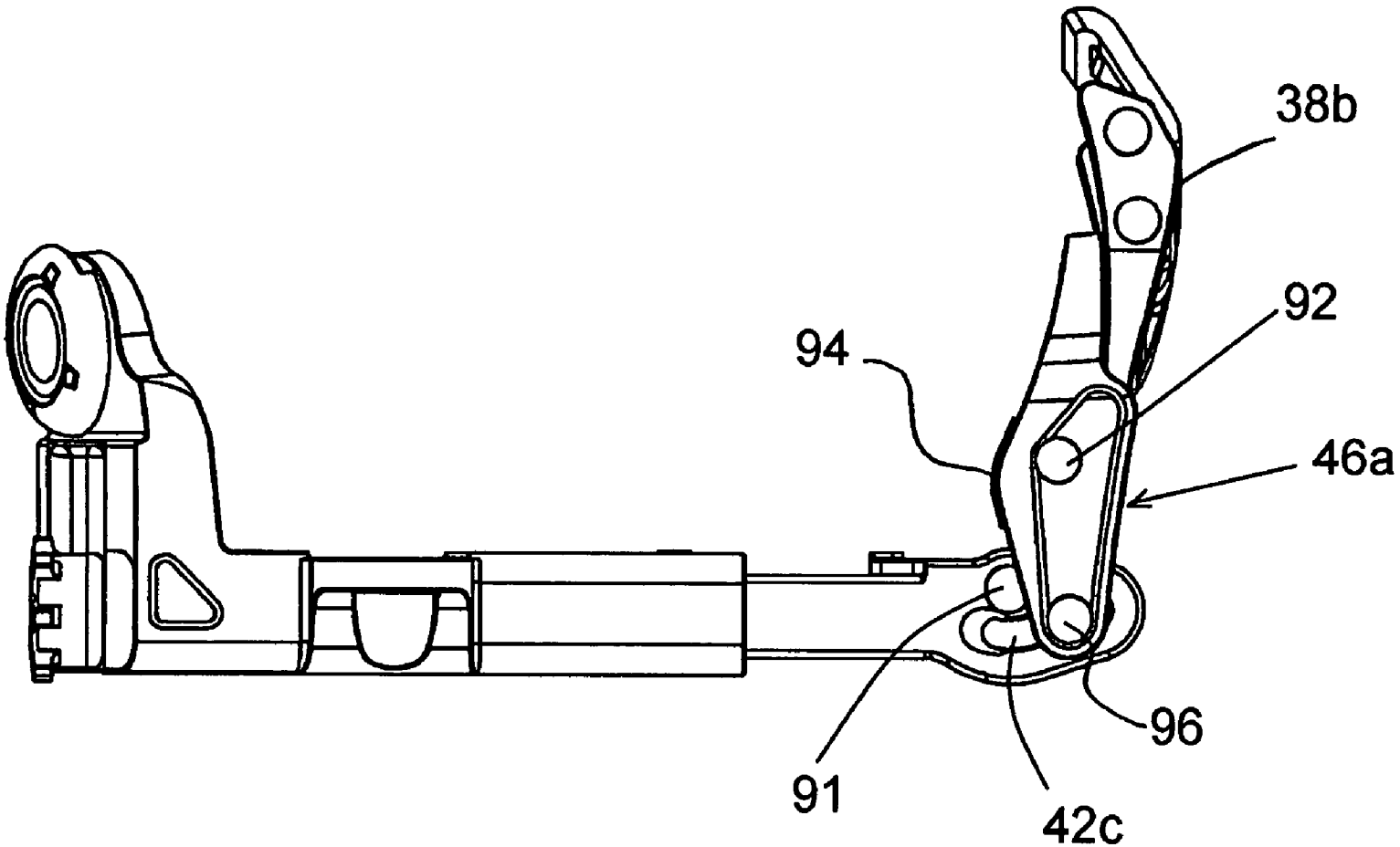

FIG. 12 shows this portion of the binding in perspective, while FIGS. 13-15 show successive positions of the cam device 46*a* as it is swung up to a position of engagement with the sole of a boot. The preferred embodiment of this camming device has a relatively complex movement, not a simple pivot. A link 90, best seen in FIG. 12 and also visible in FIG. 11, is pivotally connected approximately centrally to the slider 42*a* in a laterally extending yoke 42*b* of the slider, at a pivot 91. The link is secured at its upper/outer end to the body of the camming device 46*a*, at a pivot 92. The camming device body is preferably shaped as shown, with a "high point" 94 along a horizontal line. The pivot connection axis 92 is just above the high point. The bottom end of the camming device body 46*a* is secured in a sliding connection with the slider 42*a*, via slots 42*c* on both sides of the yoke 42*b*. A pin 96 holds the lower end of the camming device 46*a* in the slots 42*c*.

When the camming device is in the fully extended, laid-down position shown in FIG. 13, its bottom end is pushed into the deepest end of the slot 42*c* and the link 90 is essentially horizontal. As the camming device is pivoted upwardly to engage a shoe, the pivoting action is about the link's lower pivot 91. Initially the bottom end of the camming device moves very little in the sliding slot 42*c*, but as the camming device reaches approximately the position shown in FIG. 4 the bottom end swings more rapidly. As the device approaches the fully engaged position shown in FIG. 15, the bottom end of the camming device, at the pin 96, swings very rapidly to the back of the slot 42*c*, due to the relative positions of the pin 96 and the pivot axes 91 and 92. Any back-force exerted upon the shoe outwardly against the camming device, at a level lower than about the level of the pivot axis 92 for the link, will not release the cam but will tend to lock it more firmly in the engaged position. Force exerted at a higher position, however, will release the camming device, assisting the user in releasing the binding from the shoe, as the user releases the strap 32 via the buckle 38*b*.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A binding that firmly grips a user's boot to retain the boot in the binding without the need for a heel strap, for a snowshoe or other outdoor terrain-engaging implement, comprising:

a binding footbed with a foot bearing area for receiving the toe or ball of the foot area of a user's boot, a foot strap passing over the boot near the ball of the foot area, a footbed portion with a rear bearing area for receiving a region of the user's boot rear of a maximum width of the boot, a rear strap secured to the footbed at or near the rear bearing area and passing over the boot generally forward of the arch area for connection back to the footbed generally at the rear bearing area, and a boot sole clamp connected to the footbed generally at the rear bearing area, positioned to laterally engage the boot at inner and outer sides of the sole where the sole is narrower than in the ball of the foot area, to laterally clamp the boot sole from said inner and outer opposed sides of the sole, to the extent that the binding firmly engages the user's boot with opposed lateral clamping forces to lock the boot in place so that the boot will not pull back out of the binding.

2. A binding according to claim 1, wherein the boot sole clamp comprises the rear bearing area of the footbed being relatively rigid and extending across the width of the footbed, an adjustable sole gripper with sole engaging elements on each side of the rear bearing area, the sole gripper having a release position and an engage position such that the sole gripper can be moved by the user from the release position to the engage position to firmly laterally grip the sole of the boot in an area forward of the boot's arch and rearward of the maximum width of the boot.

3. A binding according to claim 2, wherein the adjustable sole gripper includes an extension connected to the footbed in the rear bearing area and extending adjacent to the sole, and a cam pivotly connected to the extension and having said two positions, the release position wherein the cam is swung out and away from the boot sole, and the engage position wherein the cam is swung inwardly on the pivot connection, engaging a camming surface of the cam firmly against the boot sole.

4. A binding according to claim 3, wherein the footbed at the rear bearing area has a fixed sole engaging lip connected to the footbed at one side, as one of said sole engaging elements.

5. A binding according to claim 3, wherein the cam is connected to a strap buckle pivotly connected to the extension, and wherein the rear strap is connected to the strap buckle and adjustable via the buckle, such that when the rear strap is pulled to tighten the strap through the buckle, pulling force on the strap lifts an upper end of the buckle to pivot the buckle on the extension thereby causing the cam to engage against the boot sole, thus effecting tightening of the rear strap and firm engagement of the sole at the arch rear bearing area with a single manipulation by the user.

6. A binding according to claim 5, wherein the release position of the cam has the cam swung outwardly and downwardly sufficiently that the cam is essentially flush with the rear bearing area and does not obstruct a forward insertion of a user's boot over the rear bearing area.

7. A binding according to claim 5, wherein the front strap and the rear strap are connected together at strap tail ends used to tighten the straps, forming a single loop to tighten both straps, the toe or ball of the foot area of the footbed including a tightening buckle through which the front strap passes.

8. A snowshoe binding according to claim 1, wherein the front strap and the rear strap each have tail ends used to tighten the straps, and wherein the tail ends are connected together forming a single loop to tighten both straps, the toe or ball of the foot area of the footbed including a tightening buckle through which the front strap passes and the footbed at the rear bearing area also including a tightening buckle through which the rear strap passes, with the loop extending from both buckles.

9. A binding according to claim 5, wherein the footbed at the rear bearing area has a fixed sole engaging lip connected to the footbed at one side, as one of said sole engaging elements, and wherein the blocking means includes, within the rear bearing area of the footbed, a slider which laterally slides in or out to adjust width between the sole-engaging lip and the extension, with locking means for holding the slider in a selected position to prevent expansion of width from that position, whereby different boot sizes can be accommodated in the snowshoe binding.

10. A binding according to claim 9, including a screw adjustment in the rear bearing area of the footbed, connected to the slider such that manual rotation of the screw adjustment moves the slider laterally in or out, the screw adjustment serving as said locking means.

11. A binding according to claim 9, wherein the locking means comprises a one-way ratcheting engagement of the slider in the rear bearing area of the footbed, and includes a release, such that the slider normally can only be pushed inward to decrease width, with the slider locked against pulling outwardly unless the release is manually deployed.

12. A binding according to claim 2, wherein the footbed at the rear bearing area has a fixed sole engaging lip at one side, serving as one of said sole engaging elements, and wherein the adjustable sole gripper includes a slider in the rear bearing area of the footbed, slidable laterally relative to the fixed sole-engaging lip so as to adjust width for different boot sizes, and including locking means for preventing expansion movement of the slider once an adjustment position has been selected.

13. A binding according to claim 1, wherein the binding footbed is flexible so as to allow flexing of the footbed in a pitch direction as the user's boot flexes while taking steps.

14. A binding according to claim 13, wherein the front strap and the rear strap are independently connected to the footbed such that the straps do not hinder flexing of the footbed with the boot.

15. A binding according to claim 5, wherein the strap buckle comprises a cam lock buckle.

16. A binding according to claim 15, wherein the cam lock buckle includes a roller over which the strap passes and generally reverses direction, for lower friction in tightening the strap.

17. A binding according to claim 16, wherein the rear strap is textured and with a water-resistant coating at the exterior of the strap, whereby the roller provides for easier adjustment of the strap as it slides through the buckle.

18. A binding according to claim 1, wherein the toe or ball of the foot area of the footbed includes a tightening buckle through which the front strap passes and the footbed rear bearing area also includes a tightening buckle through which the rear strap passes, and the buckles comprising cam lock buckles.

19. A binding according to claim 18, wherein each cam lock buckle includes a roller over which the strap passes and generally reverses direction, for lower friction in tightening and loosening the strap.

20. A binding according to claim 19, wherein the straps are textured, and with a water-resistant coating at the exterior of the strap, whereby the roller in each buckle provides for easier adjustment of the strap as it slides through the buckle.

21. A binding according to claim 20, wherein the textured straps are corrugated, with a series of parallel corrugations extending laterally in the straps.

22. A binding according to claim 1, wherein the rear bearing area of the footbed is relatively rigid and extends through the width of the sole of a boot, providing stability at the arch area against twisting of the boot in a generally horizontal plane.

23. A binding that firmly grips a user's boot to retain the boot in the binding without the need for a heel strap, for a snowshoe or other outdoor terrain-engaging implement, comprising:

a binding footbed with a foot bearing area for receiving the toe or ball of the foot area of a user's boot, a foot strap passing over the boot near the ball of the foot area, a footbed portion with a rear bearing area for receiving a region of the user's boot rear of a maximum width of the boot, a rear strap secured to the footbed at or near the rear bearing area and passing over the boot generally forward of the arch area for connection back to the footbed generally at the rear bearing area, and blocking means connected to the footbed generally at the rear bearing area, for laterally engaging the boot at the sides of the sole where the sole is narrower than in the ball of the foot area, to laterally clamp the boot sole, to the extent that the binding firmly engages the user's boot so that the boot will not pull back out of the binding, including an adjustable slider in the rear bearing area of the footbed, laterally slidable to adjust the width of the blocking means for different boot sizes, with locking means to hold the slider in a selected position.

24. A binding according to claim 23, including a screw adjustment in the rear bearing area of the footbed, connected to the slider such that manual rotation of the screw adjustment moves the slider laterally in or out, the screw adjustment serving as said locking means.

25. A binding that firmly grips a user's boot to retain the boot in the binding without the need for a heel strap, for a snowshoe or other outdoor terrain-engaging implement, comprising:

a binding footbed with a foot bearing area for receiving the toe or ball of the foot area of a user's boot, a footbed portion with a rear bearing area for receiving a region of the user's boot rear of a maximum width of the boot, at least one strap extending from one side of the footbed to the other and engageable over a user's boot, and a boot sole clamp connected to the footbed generally at the rear bearing area, positioned to laterally engage the boot at inner and outer opposed sides of the sole where the sole is narrower than in the ball of the foot area, to laterally clamp the boot sole from said inner and outer opposed sides of the sole, to the extent that the binding firmly engages the user's boot with opposed lateral clamping forces to lock the boot in place so that the boot will not pull back out of the binding.

26. A binding according to claim 25, wherein the boot sole clamp is width-adjustable by a user to accommodate soles of different widths.

* * * * *